US005751820A

United States Patent [19]

Taenzer

[11] Patent Number: 5,751,820

[45] Date of Patent: May 12, 1998

[54] INTEGRATED CIRCUIT DESIGN FOR A PERSONAL USE WIRELESS COMMUNICATION SYSTEM UTILIZING REFLECTION

[75] Inventor: Jon C. Taenzer, Los Altos, Calif.

[73] Assignee: ReSound Corporation, Redwood City, Calif.

[21] Appl. No.: 832,573

[22] Filed: Apr. 2, 1997

[51] Int. Cl.[6] ..... H04R 25/00

[52] U.S. Cl. ..... 381/68; 455/66; 455/100

[58] Field of Search ..... 381/68, 68.2, 68.4, 381/23.1, 68.6, 68.7; 455/66, 100, 575, 90

[56] References Cited

U.S. PATENT DOCUMENTS

| | | | |
|---|---|---|---|
| 4,334,315 | 6/1982 | Ono et al. | 455/100 |
| 5,479,522 | 12/1995 | Lindemann et al. | 381/68 |
| 5,621,913 | 4/1997 | Tuttle et al. | 455/66 |

*Primary Examiner*—Huyen Le

*Attorney, Agent, or Firm*—Burns, Doane, Swecker & Mathis, LLP

[57] ABSTRACT

An integrated circuit chip set design for a wireless hearing aid communication system including a battery operated transceiver unit worn in the vicinity of the ear of the user and a compact battery operated transmitter/receiver unit worn by or in close range of the user. The basis of the integrated circuit chip set design is to optimize circuit size, speed, power, and manufacturability for a personal use wireless audio communication system using the reflective transmission technology. Power and speed consideration of the circuits are designed to accommodate wireless audio RF reflective transmissions for a close range to the user. The transceiver and the receiver of the system are designed to switch between certain transmission states in order to facilitate rapid switching between a first mode in which the transmitter is transmitting to the receiver and a second mode in which the transceiver is transmitting to the receiver. The circuits are also integrated using a GaAs process and are operated in the multi-GHz range so that the circuits dissipate relatively low power.

15 Claims, 5 Drawing Sheets

INTEGRATED CIRCUIT DESIGN FOR A PERSONAL USE WIRELESS COMMUNICATION SYSTEM UTILIZING REFLECTION

FIELD OF THE INVENTION

The present invention relates to a communication system using reflective transmission technology, and more particularly to a hearing aid system using reflective transmission technology to transmit audio signals between a earpiece transceiver and a transmitter/receiver device.

DESCRIPTION OF RELATED ART

Recently, reflective transmission technology has been considered for use in European toll systems. This type of reflective system includes a transceiver device (typically in the form of a card) which resides within an automobile and which has the ability to record or store a money amount. The transceiver, is a very low power device designed to be as small and simple as possible so as to be convenient for the user and to be a low cost unit for high quantity manufacturability for use by many motorists. It typically includes a Lithium battery power source that provides a minimal power supply—enough to power a simple switching circuit for a relatively long period of time but not enough to perform RF signal transmissions.

The system also includes a transmitter/receiver which resides in the vicinity of the toll both and which typically receives its power from a commercial power line. Consequently, conservation of power usage is not a consideration for the transmitter/receiver. Unlike the transceiver card, the transmitter/receiver power usage, circuit size, and cost do not represent design limitations when compared to the transceiver due to the fact that there are much fewer tollbooths than automobiles and since the size and cost of the transmitter/receiver is not limited by consumer use.

The toll both transmitter/receiver and the automobile card transceiver communicate so that a portion of the stored monetary value is taken from the card when the automobile passes (but does not stop) by the tollbooth. This communication is performed in two modes. In the first mode, communication is from the transmitter to the transceiver such that the transmitter transmits a modulated signal representing a series of commands or requests and the transceiver receives this modulated signal. In this mode the transmitter provides the power to perform the transmission and the transceiver uses its minimal power source to receive the signal.

In the second mode communication is from the transceiver to the receiver. However, as noted above, the transceiver does not have a power source sufficient to perform RF signal transmission. Hence, in order for the transceiver to communicate back to the transmitter/receiver, the transmitter transmits an unmodulated signal to the transceiver. The transceiver, in turn, includes a switch circuit coupled to the transceiver antenna which is driven by the low power source of the transceiver. While receiving the unmodulated signal, the transceiver either shorts or grounds the switch circuit causing a relative phase shift of 180° in the unmodulated signal dependent on the state of the switch. In effect, the switch BPSK modulates the unmodulated signal being transmitted from the transmitter. A portion of this modulated signal is reflected off of the transceiver antenna and is received by the receiver. Consequently, the transceiver is able to perform a transmission by using the RF signal power provided by the transmitter.

The data rate of transmission in this system is very low since the data being transmitted is relatively simple protocol commands and replies. As a result, the data rate for the toll both system is in the range of a few kilobits/second. In addition, there is also no strict requirement as to the amount of time it takes to switch between the first and second modes of operation, i.e., the amount of time for the transceiver to go from a receive mode to a transmit mode or conversely the amount of time for the transmitter to go from a transmit mode to the mode in which it is constantly sending RF carrier power to allow the transceiver to transmit data. In practical terms, the system is only restricted by the time it may take a car to drive out of the range of the transmitter/receiver antenna before completing the toll transaction. Thus, switching from a mode in which the transmitter interrogates the transceiver to a mode in which the transceiver replies can take in the range of 10 msecs, while switching back to the original mode in which the transmitter interrogates the next car to pass through the toll both can take seconds.

Reflective technology has also been considered for use in a hearing aid device system. Specifically, U.S. patent application 08/479,629 assigned to Mimic Incorporated entitled "Hearing Aid with Wireless Remote Processor" discloses bi-directional wireless transmission of signals between an earpiece and a remote processor unit (RPU) using reflective technology where the earpiece is powered by a minimal power source and the battery operated RPU provides the power to perform the transmissions for uplinking (i.e. transmitting a signal from the RPU to the earpiece) and for down linking (i.e. transmitting a signal from the earpiece to the RPU). This patent application discloses using the reflective technology in a hearing aid system and a general block diagram of the reflective technology hearing aid communication system but does not disclose actual circuit design specifics for the practical implementation of the hearing aid system using the reflective technology concept.

SUMMARY OF THE INVENTION

The present invention is an integrated circuit chip set design for a wireless communication system using reflective technology and particularly for a wireless hearing aid system utilizing reflective technology. In one embodiment, the communication system comprises a set of integrated circuit chips to implement the transmitter, receiver, and transceiver of the system. In one embodiment, the set includes at least two chips; one for the transceiver and another including circuitry for the transmitter and receiver. In other embodiments, the chip set may include more than two chips.

The basis of the integrated circuit designs is to optimize circuit size, speed, power, and manufacturability for a personal use wireless communication system using the reflective transmission technology. In one embodiment, the power and speed consideration of the circuits are designed to accommodate bi-directional wireless RF reflective transmissions between the ear area and the hip/waist area of the user. In other implementations transmission is optimized for transmissions between the ear area and other electrical units in close proximity to the user.

The circuits are integrated using a GaAs process so that the circuits dissipate relatively low power while functioning with a relatively high RF carrier signal. The frequency range of the RF signal is selected so as to ensure the design of a relatively small yet efficient transceiver antenna that is convenient for use as a hearing piece.

System power is selected to facilitate a transmission range of a signal in a relatively close range about a user (referred to as a nanocell). This design consideration optimizes the system in an application in which multiple system users are in relative close proximity. In this case, system power is selected to ensure quality transmissions within a users' nanocell while ensuring that transmissions do not interfere with other users' nanocells. In one implementation of the system using the chip set design, a first user speaks into a microphone of the transmitter and a second user receives the audio signals from the first user from a transceiver within their ear. In this case, the nanocell transmission range is in the range of 10 to 50 feet and system power is selected accordingly. In another implementation of the system using the chip set design, the user places the transceiver in their ear and the transmitter/receiver unit in the vicinity of their waist. In this case, the nanocell transmission range is in the range of 1–5 feet and system power is selected to accommodate this transmission range.

In addition, the chip set is designed to optimize power usage for performing transmissions in a personal wireless two-way communication system in which both the transceiver and the transmitter/receiver units are essentially mobile.

In accordance with the chip set design concept of the present invention, one embodiment of the transmitter chip provides three oscillation signals having a given frequency—a first signal for use when transmitting a modulated or unmodulated signal from the transmitter to the transceiver, a second signal for providing a reference signal to the receiver, and a third signal for controlling a feedback loop stabilization circuit. In an alternate embodiment of the present invention multiple reference signals maybe provided in the case when multiple reception diversity is used. In one embodiment, a GaAs integrated circuit transmitter chip is designed in order to minimize the power dissipation and size of the transmitter by including both an oscillator for generating the three oscillation signals as well as the feedback loop stabilization circuit in the integrated circuit design. Signal transmission efficiency is increased by optimizing impedance matching for all three outputs of the transmitter integrated circuit. The impedance is matched such that the maximum voltage standing wave ratio (VSWR) on all outputs is 2:1. In one embodiment of the transmitter integrated circuit, a power amplifier stage is included to optimize battery use for ensuring that the continuously transmitted unmodulated signal sent to the transceiver during the reflective transmission mode is a 17 dBm output signal. Furthermore, power consumption is reduced by adjusting the gain of the power amplifier depending on the signal that the transmitter is sending. Power consumption as it relates to the power source of the transmitter integrated circuit and the current drainage are set in consideration of the intended use of the user and to ensure enough power is available to perform the reflective transmission within the nanocell to the user. In one embodiment of the transmitter circuit, the power consumption rating is in the range of 100 mA at a 4.0 volt supply voltage. In addition the transmitter circuit is designed with a power saving sleep mode in which non-required circuitry within the transmitter shuts-down (or is essentially shut down) when not in use.

In accordance with one embodiment of the chip set design, a receiver chip functions to receive the reflective signals from the transceiver and is optimized in a number of ways to ensure clear reception of the reflected signal from the transceiver. In one embodiment, the receiver chip includes a low-noise amplifier (LNA) coupled to an external input antenna. The LNA functions to maximize the sensitivity of the receiver to the reflected signal from the transceiver allowing high data rate communication with minimal RF carrier power. In one embodiment the LNA is designed such that the receiver's RF input provides a <3 dB noise figure (NF). In one embodiment, a signal processing portion performs baseband signal amplification and filtering as well as signal detection using a data recovery comparator for restoring the received digital signal. The integrated circuit is also designed for quick mode switching when going from a non-receive mode to a receive mode so as to allow the transceiver to sample and transmit audio signals at a rate of greater than twice the highest frequency of the audio signals to be sent by the transceiver. In one embodiment, non-receive-to-receive mode switching is performed in 5–10μ seconds. Finally, the receiver integrated circuit is also designed with a power saving sleep mode in which non-required circuitry within the receiver shuts-down (or is essentially shut-down) when not in use.

In accordance with another embodiment of the chip set design of the present invention, the transceiver chip is optimized for rapid transmit-to-receive and receive-to-transmit switching to allow for high grade audio signal sampling and transmission rates. In one embodiment, the transceiver transmit-to-receive mode switching is performed in 5–10μ seconds. Like the receiver portion, the transceiver integrated circuit also includes signal processing stages which perform baseband detector amplification, filtering, and signal restoration with a data recovery comparator. The voltage supply requirement and current drainage (i.e. power consumption) of the transceiver integrated circuit are minimized in consideration that the transceiver is generally worn as a battery powered wireless earpiece and battery life is preferably kept as long as possible.

In one embodiment of the design of the chip set, both of the uplink and downlink signals comprise digital audio signals. In an alternative embodiment, one of the uplink and downlink signals comprises a digital audio signal while the other of the uplink and downlink signals comprises a digital data signal.

DESCRIPTION OF PREFERRED EMBODIMENT

Figure 1A:
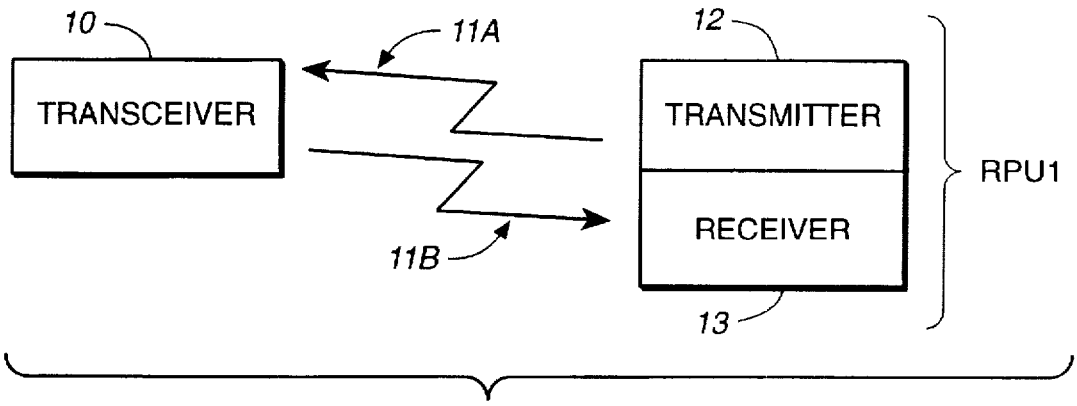
FIG. 1A shows the elements of a reflective communication system.
Figure 1B:
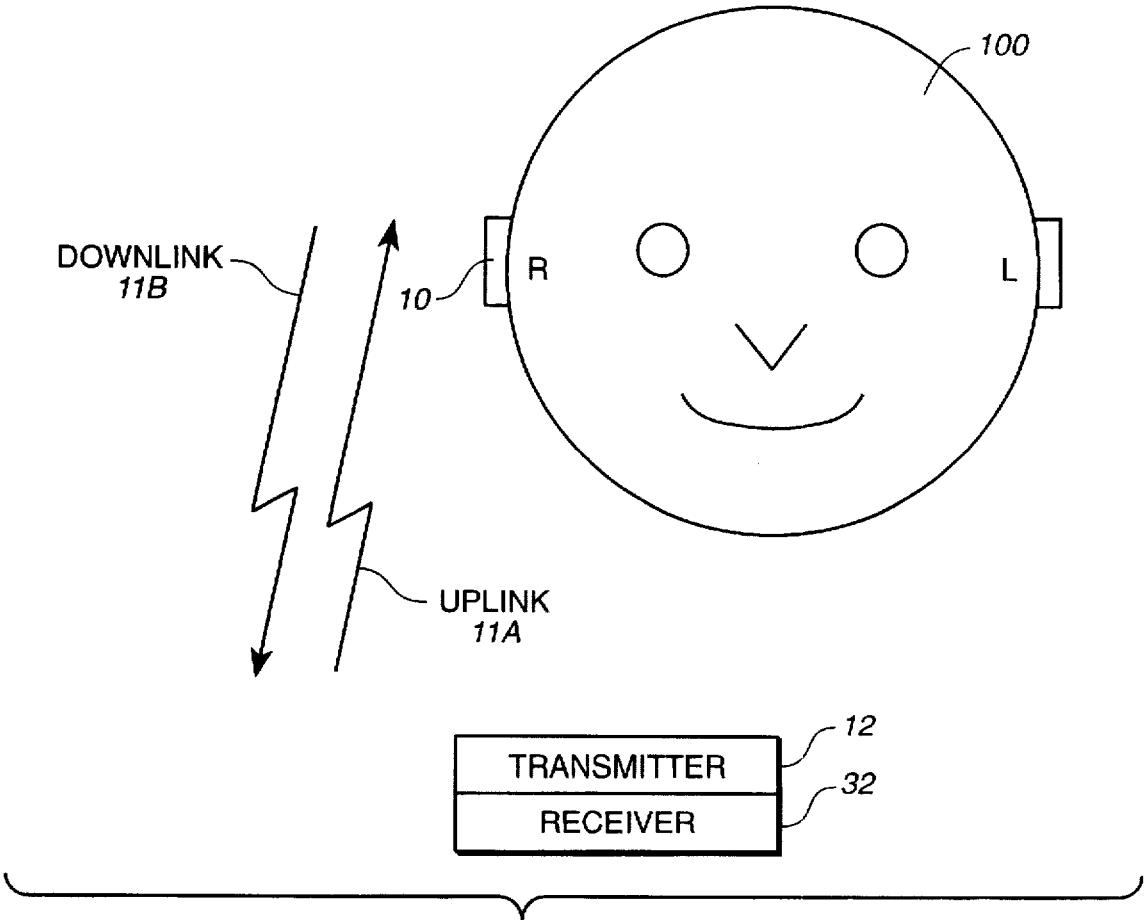
FIG. 1B shows a reflective communication system used as a personal hearing aid device.

A basic wireless communication system implemented with a reflective technology includes three logical elements: a transceiver 10, a transmitter 12, and a receiver 13 (FIG. 1A). FIG. 1B illustrates the system as implemented as a wireless personal communication system as disclosed in U.S. application Ser. No. 08/479,629 and assigned to Mimic Incorporated wherein the transceiver 10 resides in or within the vicinity of the ear and the transmitter 12 and receiver 13 (referred to as the remote processing unit, RPU1) reside in close proximity to the user. For instance, in different applications of the system, the transmitter/receiver may be located in the waist/hip vicinity of the user. This implementation is most practical when using the system as a hearing aid device. In other applications of the system, the transmitter/receiver may be located within other electrical devices in close proximity to the system user (referred to as the nanocell of the user) so as to allow transmissions between the electrical device and the user. In this application, the transmitter/receiver may reside within a telephone or a computer system and the user may communicate either data or audio signals to the electrical device.

The basic concept of a reflective technology communication system is that the transceiver is designed to require little power and is typically compact in size while the transmitter/receiver provides the majority of the RF power for transmitting uplink and downlink signals (11A and 11B) between the transceiver 10 and the transmitter 12/receiver 13 and is typically less restricted in size and power.

The communication system shown in FIGS. 1A and 1B function in the following manner. In a first mode, the transmitter 12 wirelessly transmits (via an antenna) uplink signal 11A to transceiver 10. Uplink signal 11A is an RF (radio frequency) signal that is modulated with the information to be transmitted to the transceiver. The transceiver receives (via an antenna) uplink signal 11A and demodulates the signal while consuming no power at RF frequencies. In a second mode, transceiver 10 wirelessly transmits (via an antenna) downlink signal 11B to receiver 13. Downlink signal 11B is also an RF signal which has been modulated with information to be transmitted to receiver 13. Downlink signal 11B is generated in accordance with the reflective technology such that during the second mode, transmitter 12 transmits an unmodulated signal to the transceiver 10. The transceiver receives the unmodulated signal with an antenna that is coupled to a passive modulator. The transceiver modulates the unmodulated signal, for example, by switching the antenna connection to either ground or an open wherein there is a 180° phase shift in the unmodulated signal depending on the position of the switch (i.e. open or ground). In other embodiments, other types of modulation may be performed. The modulated signal is reflected to the receiver 13 as downlink signal 11B. Hence, in the first mode of transmission, the transmitter is sending the modulated uplink signal 11A, the transceiver is receiving the uplink signal 11A, and the receiver is on standby. Alternately, in the second mode, the transmitter is transmitting an unmodulated signal, the transceiver is receiving and modulating the unmodulated signal and reflecting it in the form of the modulated downlink signal 11B, and the receiver is receiving downlink signal 11B.

This type of communication system (i.e., reflective technology type) allows for half duplex communication between the transceiver and the transmitter/receiver. Specifically, uplink and downlink signals are not simultaneously transmitted. However, in the embodiment of the communication system shown in FIG. 1B, it is desirable to have a full-duplex system wherein communication between the transceiver and the transmitter/receiver unit occurs at the same time. The communication system shown in FIG. 1B is designed so that it appears to be a full-duplex system to the user by performing mode switching at a rate such that it appears that uplink and downlink signals are being transmitted simultaneously. In order to achieve this type of switching rate, each of the main elements of the communication system (i.e., the transceiver, transmitter and receiver) are designed so that they can individually rapidly switch from one particular transmission state to another transmission state. For instance, in the case of the receiver, the receiver needs to be designed so that it rapidly switches from a non-receiver state to a receiver state. Similarly, the transceiver needs to be able to rapidly switch from a transmit state to a receiver state and back again. Minimizing the delay for each of these elements to switch between these states allows the reflective type communication system to simulate the operation of a full-duplex system.

In the implementation of the personal communication system shown in FIG. 1B as a hearing aid for receiving audio signals, a microphone in the earpiece picks up ambient sounds from the environment, a digital system (not shown) then digitally samples the audio signals, and formats them into suitable wireless transmission "packets". These packets are then transmitted (downlink signal 11B) to the receiver 13 in the manner as described above using reflective technology. The receiver extracts the communication information from the received signal and a digital system (not shown) processes and enhances the extracted signal so as to compensate for the user's hearing problem, reassembles it back into packets, and then sends it back using transmitter 12 to the transceiver 10 (as uplink signal 11A) where the enhanced sound is provided to the user via a speaker.

Each packet preferably contains one or more digital samples. Digital sampling is performed at a rate to ensure that the user receives a high quality audio signal. As is well known in the field of communication, according to the Nyquist Theorem, a signal must be sampled at or above twice its highest frequency in order to obtain enough information to reconstructed back into the original signal. In accordance with telecommunication standards, this represents a sampling rate of at least 7.0K samples per second (Ksps). However, for high grade audio signal transmission, a sampling rate in the range of 32.0 Ksps–40.0 Ksps is typical. In order for the reflective system (FIG. 1B) to be able to support a sampling frequency of this rate, each element within the system must be able to individually switch between transmission states in a time period so as to allow the system to perform digital sampling at a rate to allow a packet to travel from the transceiver to the transmitter/receiver and then back in the time interval before the next packet is to be transmitted. Implementing a reflective system in this manner makes it appear to be operating as a full-duplex system. If these elements are unable to switch states within the required time period, the system will be unable to support digital sampling at a high enough rate so as to provide a clear signal to the user. In one embodiment, elements switch between transmission modes within a 5—10μ second time period.

Figure 2A:
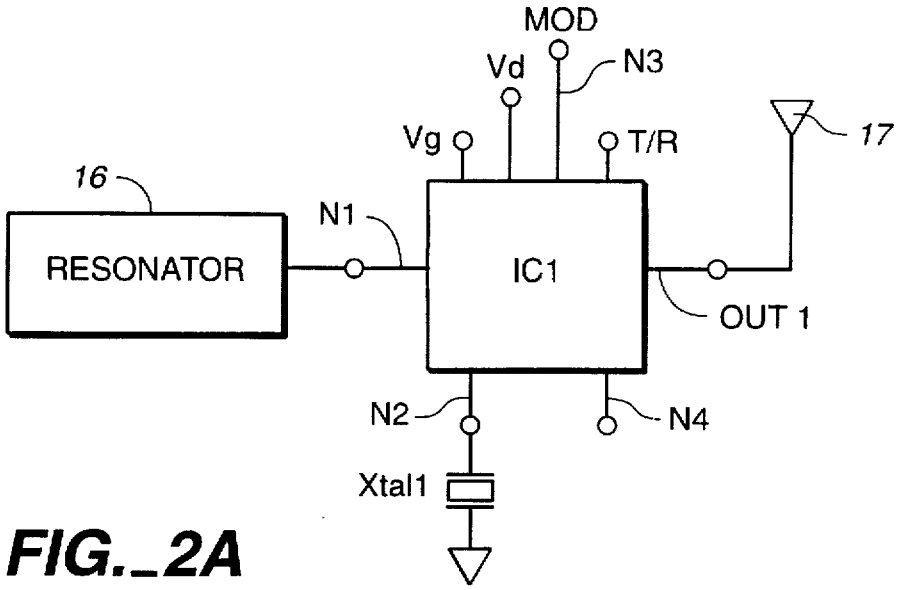
FIGS. 2A–2C show external connection nodes for the chip set design of the present invention.
Figure 2B:
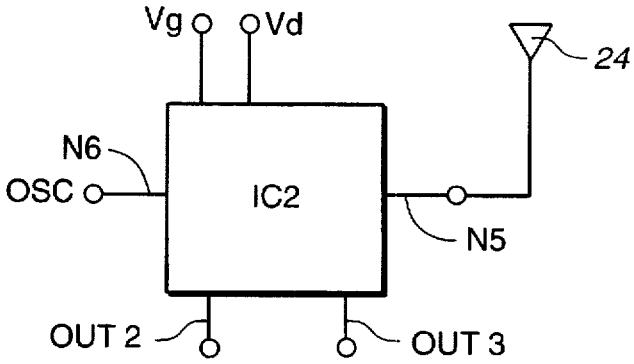
Figure 2C:
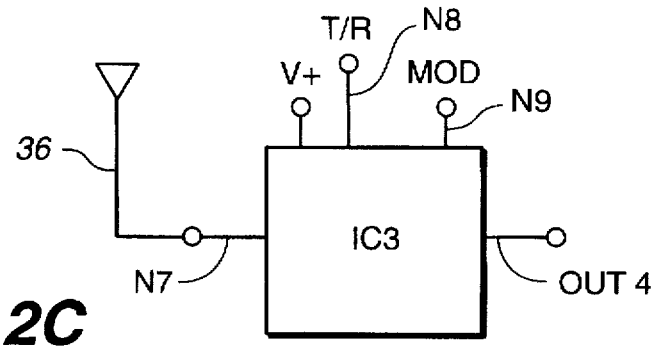

The basis for the integrated circuit chip set design of the present invention is to provide an integrated circuit chip set comprising, in one embodiment, three integrated circuit chips IC1, IC2, and IC3 (FIGS. 2A–2C) each corresponding to one of the transmitter 12, the receiver 13, and the transceiver 10, respectively. It should be understood that in other embodiments that the chip set may comprise more or less chips than three. For instance, a single chip may be used to integrate both the transmitter and receiver elements. Alternatively, more chips may be used in the case in which design considerations suggest separating certain transmitter, receiver and transceiver elements. The idea behind the chip set design is to provide a set having an optimal division of system elements to obtain the smallest and lowest power system. For instance, the embodiment shown in FIGS. 2A–2C, IC1, IC2, and IC3 are coupled to external devices. As shown, IC1 which is the chip that corresponds to the transmitter element of the communication system shown in FIG. 2A, is coupled to an external crystal (Xtal1) and a resonator device 16. Hence, in this example, some external elements are not integrated within the chip set.

Another aspect of the design concept of the chip set is to provide a design in which the user wears a battery operated transceiver within the ear and wears a battery operated transmitter/receiver unit at waist level having the following characteristics:

- a switching mode rate to allow audio signal digital sampling;
- chip sizes to facilitate compact units that fit at waist or aesthetically within the ear;
- maximum integration of elements and minimal external periphery devices for size and power consumption reduction;
- current and voltage ratings for maximum battery life;
- system power and sensitivity to received signals selected to facilitate close range transmission and minimal interference outside of a user nanocell.

The frequency range of this communication system is selected, in part, in consideration of the design of the earpiece antenna. As is well known in the communication industry, the efficiency of an antenna is dependent on its size and the highest frequency that it is receiving. In order to minimize the size of the earpiece of the present system, the antenna size must also be minimized so as to ensure convenient and inconspicuous use. Reducing the antenna size means that the frequency of the transmission signal must be increased in order to ensure sufficient antenna reception efficiency for reflection mode operation. In view of the foregoing, a transmission signal in the range of 5.0 GHz is used in one embodiment in which the antenna length is approximately ½ in. It should be understood, however, that other frequencies may be used limited by the antennas physical requirements. Moreover, power savings are realized in one embodiment in which the chip set is operated in the 5 GHz range by fabricating the chip set using a GaAs technology since GaAs integrated circuits are more power efficient in this range of frequency than silicon integrated circuits.

Transmitter Chip IC1

Figure 3:
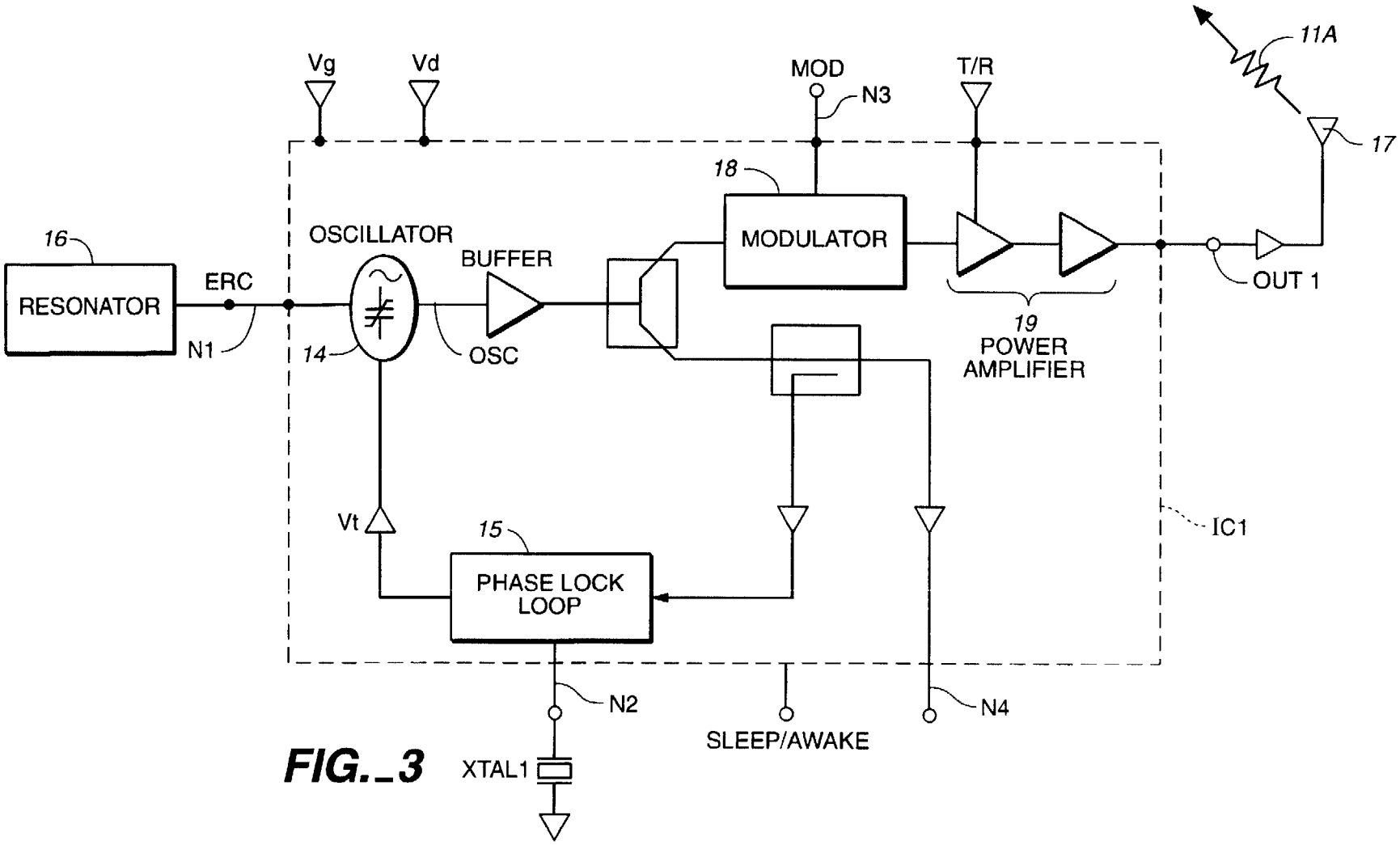
FIG. 3 shows one embodiment of the transmitter chip of the chip set design of the present invention.

FIG. 3 illustrates one embodiment of a block diagram of an integrated circuit chip IC1 used to implement a transmitter in the personal communication system shown in FIG. 1B. As shown in FIG. 3, the chip design includes oscillator circuit 14, a phase lock loop circuit 15, modulator circuit 18, and power amplifier 19. It should be understood that in other embodiments some of these elements may not be included on this chip if design considerations suggest placing them on other chips within the system.

The elements of IC1 function in the following manner. The oscillator circuit 14, in response to an external resonator device 16 (coupled at node N1), generates an oscillation signal, OSC. The oscillation signal is coupled to phase lock loop circuit 15. Phase lock loop circuit 15 is coupled to an external crystal device (Xtal1) (node N2) which provides the frequency reference of the phase lock loop circuit. The phase lock loop circuit 15 generates a feedback control signal Vt which is coupled back to the oscillator circuit 14 and which provides stabilization of the OSC signal as is well known in the field of signal communication.

Modulator 18 is responsive to an external data signal MOD coupled to IC1 on node N3. Modulator 18 modulates the oscillator signal OSC with the external data signal MOD to generate modulated uplink signal 11A on node OUT1 (via power amplifier stage 19) which is coupled to an external antenna 17. The external data signal MOD is a digital information signal provided from a communication information source (external to IC1) and coupled to node N3. In one embodiment, the digital information signal is the sampled audio signal received from the transceiver and processed by an external digital signal processor (not shown). In the case in which communication system 1B is designed to accept external communication signals such as cellular telecommunications, the information signal may alternatively come from such other external source. Regardless of the source of the digital information signal MOD, in order to transmit the digital information signal MOD to the transceiver 10, the transmitter must first modulate the information signal onto the oscillation signal OSC using modulator 18.

The oscillation signal OSC is also coupled to the receiver 13. The receiver uses the oscillation signal as a reference signal when performing demodulation of received signals. In one embodiment in which the transmitter and receiver are implemented as separate integrated chips, the oscillator signal OSC generated by the transmitter chip IC1 is coupled to the receiver chip through an output node N4. It should be noted that although FIG. 3 shows transmitter 12 providing a single OSC signal, in an alternate implementation of the system which uses multiple reception diversity, transmitter 12 may provide multiple OSC signals.

The oscillation signal OSC (unmodulated) is also transmitted to the transceiver during the second mode of operation from output node OUT1 and antenna 17. In order to provide sufficient power for the unmodulated signal to be transmitted to the transceiver and then reflected back in modulated form to the receiver, the unmodulated OSC signal is amplified by power amplifier stage 19. In the embodiment shown in FIG. 3, power savings can be realized by adjusting the gain of power amplifier stage 19 depending on whether the transmitter is in first or second modes. Specifically, when the transmitter is in the second mode it is sending an unmodulated signal to the transceiver which must then be reflected back and received by the receiver. On the other hand, in the first mode, the transmitter sends a signal that must only travel to the transceiver. In the embodiment shown, the gain of power amplifier stage may be increased under control of the T/R signal when the transmitter is in its second mode (transmit mode) and may be decreased when the transmitter is in its first mode (receive mode). The control signal (T/R) may originate from another portion of the system such as a digital signal processor. Adjusting the gain of stage 19 optimizes transmission efficiency during the second mode while providing power savings during the first mode. Note that this is an optional element and the circuit shown in FIG. 3 need not include this. In one embodiment of the present invention power amplifier 19 amplifies unmodulated signal OSC so that it is a 17 dBm output signal. Transmitter chip, IC1, also includes ground and power ports, Vg and Vd, respectively.

It should also be noted that when using the system shown in FIG. 1B in a cellular communications system such as described in the co-pending U.S. Patent Application entitled "Bandwidth Management in a Heterogenous Wireless Personal Communication System" (Attorney Docket No.: 022577-360) the transmitter/receiver functions as a pseudo base station and the earpiece functions as a pseudo transceiver stations. In conventional cellular systems, the base station is typically stationary. However, in the application in which the transceiver and the transmitter/receiver are relatively mobile interference problems can occur. Using the power amplifier stage 19 such that gain can be adjusted (i.e., increased during the reflection mode of transmission) significantly improves interference potential due to the inherent mobility of the elements of this type of cellular communication system.

IC1 is designed according to the following design considerations in accordance with the present invention. In one embodiment, the elements within IC1 are operated in a frequency range to facilitate the design of an earpiece antenna that is small and efficient. With this goal, IC1 is operated at a multi-GHz frequency. Since the oscillation frequency is in the multi-GHz frequency range, power consumption of IC1 is reduced by fabricating as many elements of the transmitter into IC1 utilizing a GaAs process instead of a Silicon (Si) fabrication process. Power savings are realized since running a Si device at frequencies in the multi-GHz range requires greater power than required by a same device fabricated out of GaAs and being operated in the same frequency range. At the same time, by integrating as many of the elements of the transmitter into IC1, the number of external devices coupled to IC1 is reduced, thereby reducing the overall size and cost of the transmitter unit.

System power is adapted for a personal communication system which only requires a minimal range of transmission. For instance, in a personal communication system, it is desirable to be able to transmit in a small cell range about the user. However, it is undesirable to enlarge this range too much since this would result in the user picking up erroneous signals and causing interference with other personal system users. Hence, system power is selected so as to optimize system performance within close range of the user. In one implementation of the system using the chip set design, a first user speakes into a microphone of the transmitter and a second user receives the audio signals from the first user from a transceiver within their ear. In this case, the nanocell transmission range is in the range of 10 to 50 feet and system power is selected accordingly. In another implementation of the system using the chip set design, the user places the transceiver in their ear and the transmitter/receiver unit in the vicinity of their waist. In this case, the nanocell transmission range is in the range of 1–5 feet and system power is selected to accommodate this transmission range.

Another design consideration of IC1 for facilitating a communication system as shown in FIG. 1B is to optimize signal transmission efficiency by optimizing impedance matching for each of the transmitter integrated circuit output ports. Specifically, the output impedance of each of output node OUT1 and node N4 are matched to the corresponding input impedance of the node that each are transmitting to. Hence the output impedance of node OUT1 is matched to the terminal impedance of the external antenna 17. Similarly, the output impedance of N4 is matched to the corresponding input impedance of node N6 of the receiver chip IC2. In one embodiment of the present invention, the impedance is matched such that the maximum voltage standing wave ratio (VSWR) on all outputs is better than 2:1. This design optimization also equates to power savings in the transmitter since poor matching results in wasted power usage. Hence, improving impedance matching also improves battery life.

By optimizing the chip design for power consumption, all functional characteristics are met while maximizing battery life and reducing heat dissipation requirements. Consequently, the chip set of the present invention avoids the use of heat sinks further reducing the size of the chip set.

Finally, IC1 is designed to include a sleep mode. FIG. 3 shows an optional sleep mode control terminal (sleep/awake) which is controlled by the digital communication control chip (not shown) which may be a DSP. In the sleep mode, all non-essential elements within IC1 are disabled or essentially shut-down for the purpose of power saving. In one implementation the sleep mode is realized by reducing bias currents within the chip. If the system 1B is used as a hearing aid, the user 100 may not receive any communications for an extended period of time (e.g., when the user is alone) and hence can realize power savings by putting the transmitter into a sleep mode either manually, with a voice recognition signal, or automatically. In this case the transmitter may be awakened by, for example, a control signal in the form of a mechanical switch or with a voice recognition signal from the user transmitted from the transceiver to the transmitter. In another embodiment in which the system is used as a cellular communication system as disclosed in U.S. patent application 08/479,629 the wake-up control may be generated when an outside cellular call is received. In still another embodiment in which the system shown in 1B is communicating with another external device such as a telephone or computer system, control may also come from each of these sources.

Receiver Chip IC2

Figure 4:
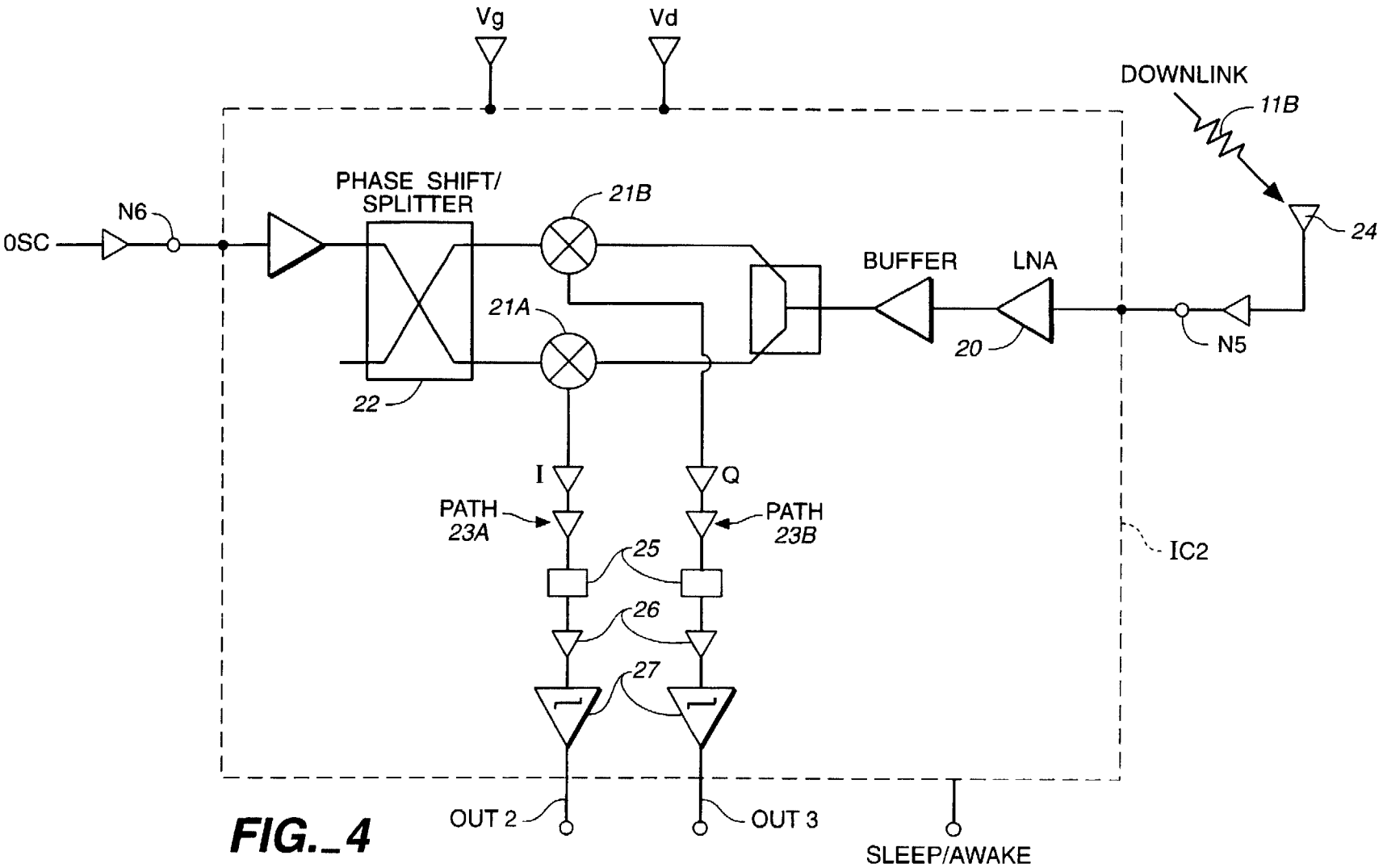
FIG. 4 shows one embodiment of the receiver chip of the chip set design of the present invention.

FIG. 4 illustrates one embodiment of a block diagram of an integrated circuit chip IC2 used to implement a receiver in the personal communication system shown in FIG. 1B. As shown in FIG. 4, the chip design includes a low noise amplifier (LNA) 20, I and Q Mixers 21A and 21B, phase shift splitter 22 and I and Q signal processing and detecting paths 23A and 23B. It should be understood that the I and Q processing and detecting paths may be integrated into other portions of the system instead of IC2 or alternatively may be integrated into other external chips.

The elements of IC2 function in the following manner. An external antenna 24 receives the reflected downlink signal 11B from the transceiver and couples the received signal to the input of LNA 20 on node N5. The LNA 20 significantly minimizing the addition of noise to the received downlink signal 11B while amplifying the communication information being transmitted. In one embodiment the LNA boasts the received signal by 11 dB. This type of amplifier improves signal quality since signals received on antenna 24 have been reflected from the transceiver and therefore tend to be weak by the time they are picked up by the antenna. In one embodiment of the present invention, the LNA is designed such that the receiver noise figure at node N5 is <3 dB. The output of LNA 20 is split into two signals and coupled to I and Q mixers 21A and 21B.

By implementing the system with both and I and Q processing paths, erroneous phase shifts created as a result of movement of the transceiver relative to the transmitter/receiver due to the user's head movement can be eliminated. The two I and Q signal paths process the received signals at a 90° phase difference. The resulting I and Q signals may then be provided to an external digital signal processing chip which can use the I and Q signals to discriminate and cancel out the erroneous phase shifts, allowing the clear recovery of the phase shift key (PSK) modulated data signals.

Phase shift splitter 22 is coupled to the oscillator signal OSC on node N6 while the OSC signal is provided by the transmitter IC1 chip from node N4. The phase shift splitter 22 performs two functions. First it splits the OSC signal so as to provide the two OSC signals for the I and Q mixers and second it shifts the phase of the signals so that there is a 90° phase difference between them. The split/shifted signals are then each coupled to one of I and Q mixers 21A and 21B along with the split output signal of LNA 20. Mixers 21A and 21B generate two IF signals representing the I (in phase) and Q (quadrature phase) components of the information signal modulated onto the downlink signal received on antenna 24.

Each of the I and Q signals are then processed by two IF type frequency processing paths 23A and 23B. Each include IF frequency filters 25, amplifiers 26, and detectors 27. IF frequency filters 25 function to filter out any other frequencies other than the desired band of frequencies in which the information signal is expected. Amplifiers 26 amplify the filtered band of output signals and, detectors 27 function to recover the I and Q information signals to provide the I and Q digital signals on output nodes OUT2 and OUT3, respectively, representing the I and Q components of the information signal received on antenna 24. OUT2 and OUT3 are coupled to an external digital signal processing unit (not shown) for extracting, processing, and enhancing the received signal prior to retransmitting it back to the transceiver (in the hearing aid application) or out to an external device such as a cell phone or computer system in another application of the system. It should be understood that the IF frequency processing paths 23A and 23B may include other elements for the purpose of further processing the IF signal and consequently these paths are not limited by the elements as shown. Receiver chip IC2 also includes ground and power ports, Vg and Vd respectively.

IC2 is designed to ensure that mode switching occurs at a rate that facilitates signal sampling of audio signals for the communication system shown in FIG. 1B. The receiver switches between a non-receive state and a receive state. That is, when the transmitter is transmitting to the transceiver, the receiver is idle and waiting to receive a transmission from the transceiver (non-receive state). When the transceiver transmits to the receiver, it is in a receive state. In the type of system as shown in FIG. 1B, the receiver is in close proximity to the transmitter portion of the system and is influenced by the transmitter. As a result, the quiescent voltage levels of the receiver are different depending on whether the transmitter is sending a modulated signal. Specifically, when the transmitter is sending a modulated signal it is putting out a signal having a duty cycle of approximately 50%. In one embodiment, this is facilitated by using Manchester encoding during modulation. This has the effect of establishing a particular quiescent voltage level in the receiver due to its proximity to the transmitter and using common grounds and power supplies, etc. However, when the transmitter switches to the second mode, the transmitter sends an unmodulated signal having a duty cycle of 100% which causes an increase in the quiescent voltage level of the receiver. Upon entering the second mode, the receiver begins to receive the reflected signal from the transceiver, however, due to the increase in its quiescent voltage level it is initially not sensitive enough to detect any signals until the quiescent voltage levels re-adjust to the higher level. This period of receiver insensitivity determines the interval of time that it takes the receiver to switch from its non-receive state to its receive state thereby influencing the overall first-to-second mode switching rate of the system. Hence, in order to ensure an adequate mode switching rate for processing signals in the system, the elements of IC2 are designed to minimize the period of receiver insensitivity. An example as to how to design the elements of IC2 so as to ensure an adequate switching rate to simulate a full duplex system is to disconnect external capacitors during certain times of operation and/or to change bias currents at certain key times during the operation of the system.

Finally, IC2 is also designed to include a sleep mode shown by the sleep/awake pin in FIG. 4. As discussed previously with the transmitter chip, in this mode, all non-essential elements within IC2 are disabled/shutdown or essentially shut-down when not in use for an extended period of time until a control signal is received.

Transceiver Chip IC3

Figure 5:
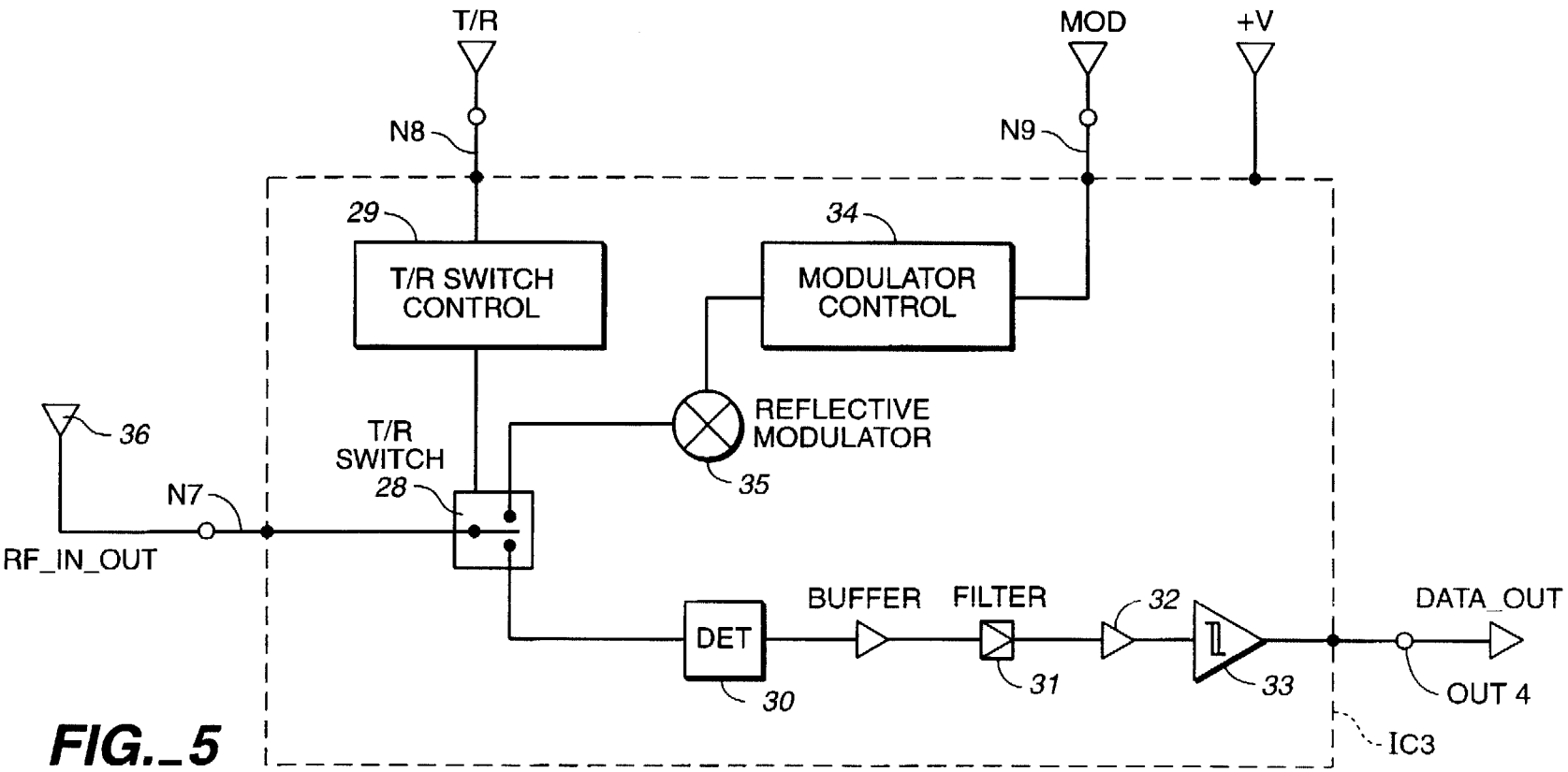
FIG. 5 shows one embodiment of the transceiver chip of the chip set design of the present invention.
Figure 1A:
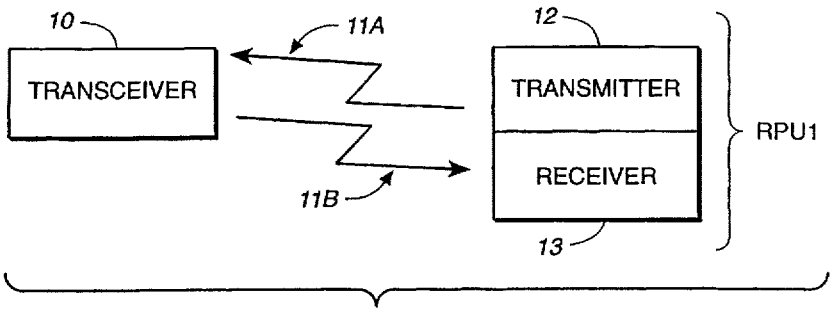
Figure 1B:
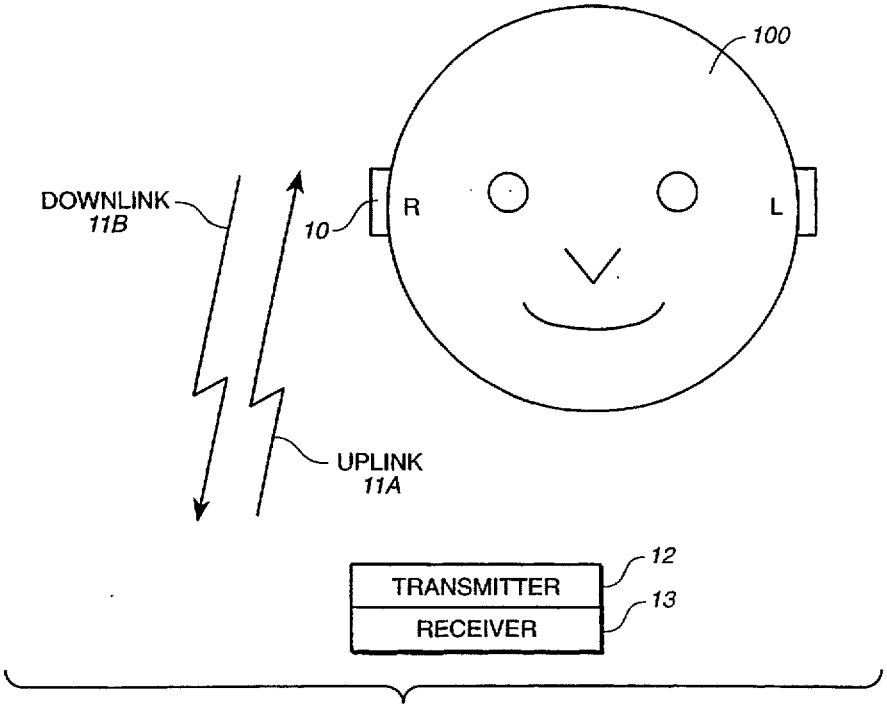
Figure 2A:
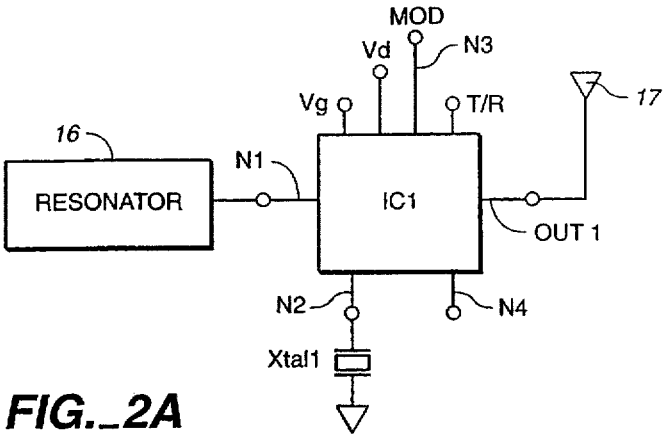
Figure 2B:
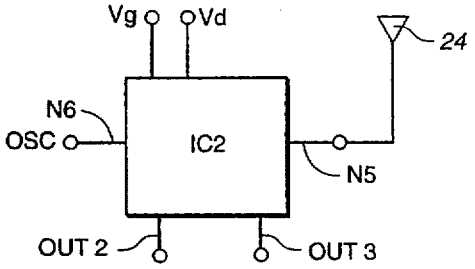
Figure 2C:
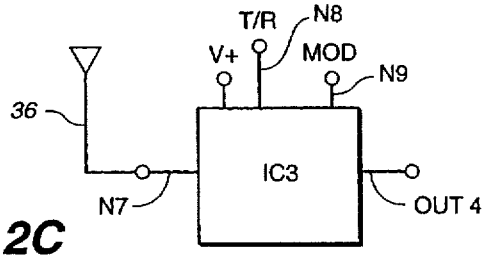
Figure 3:
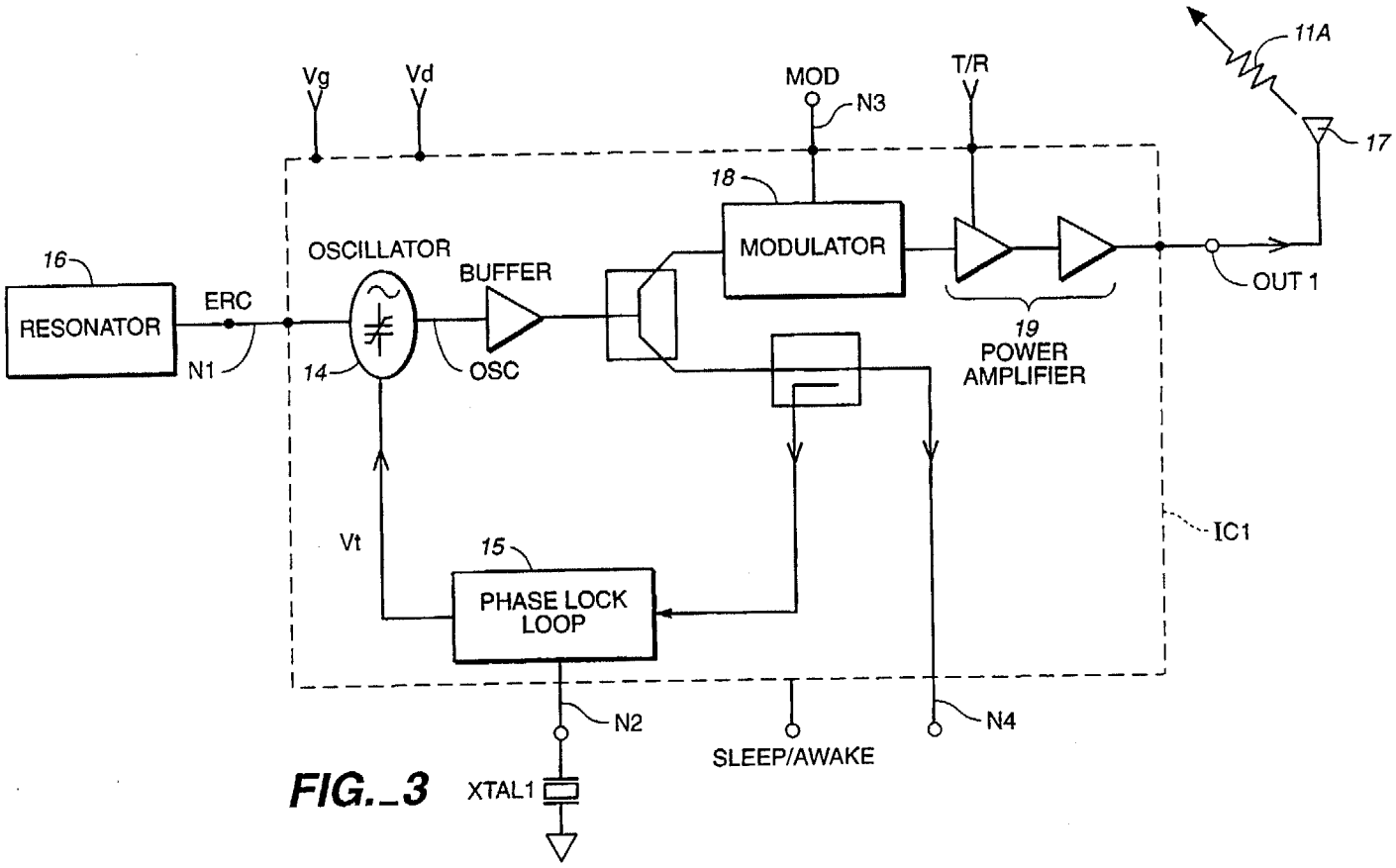
Figure 4:
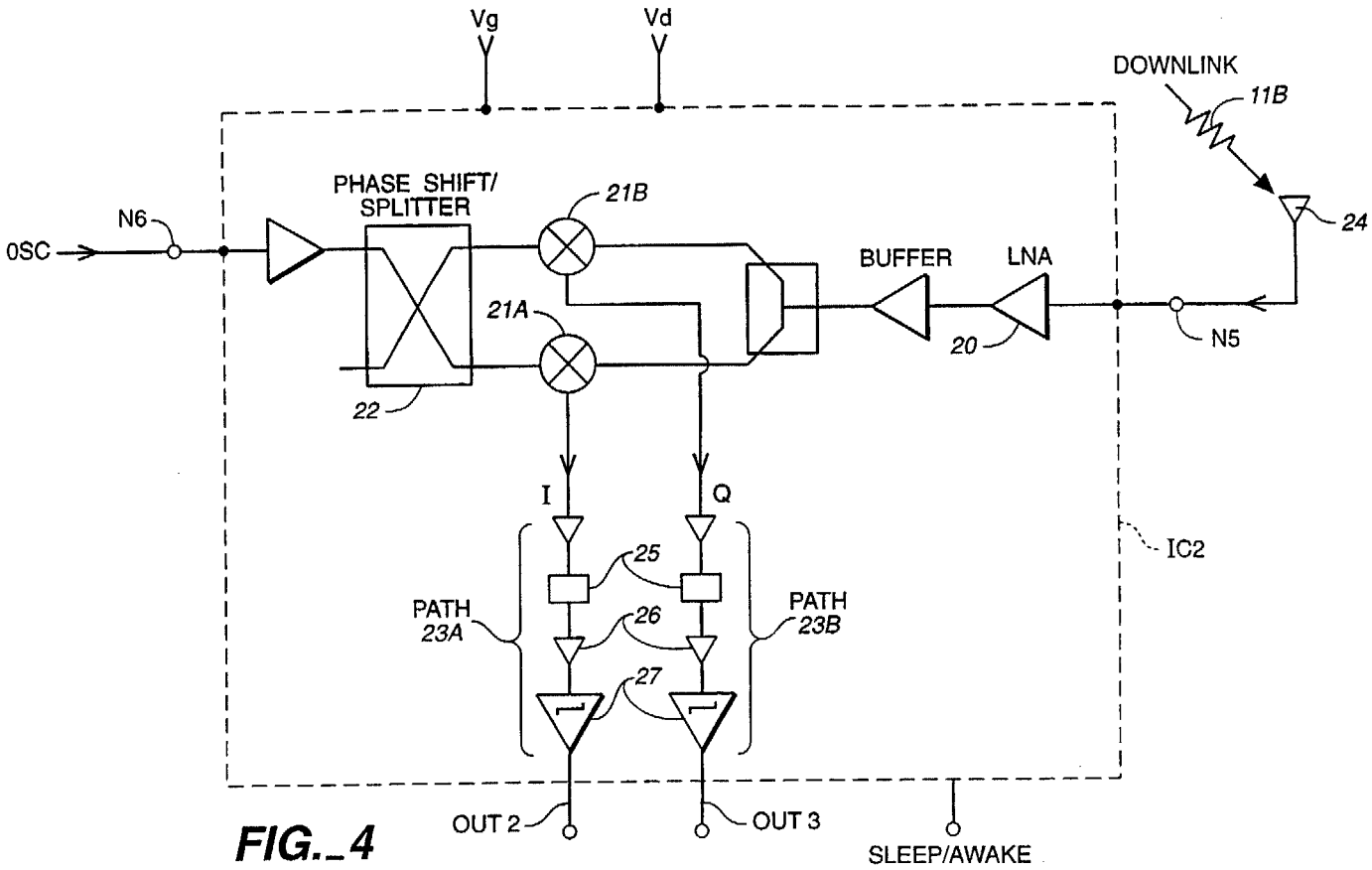
Figure 5:
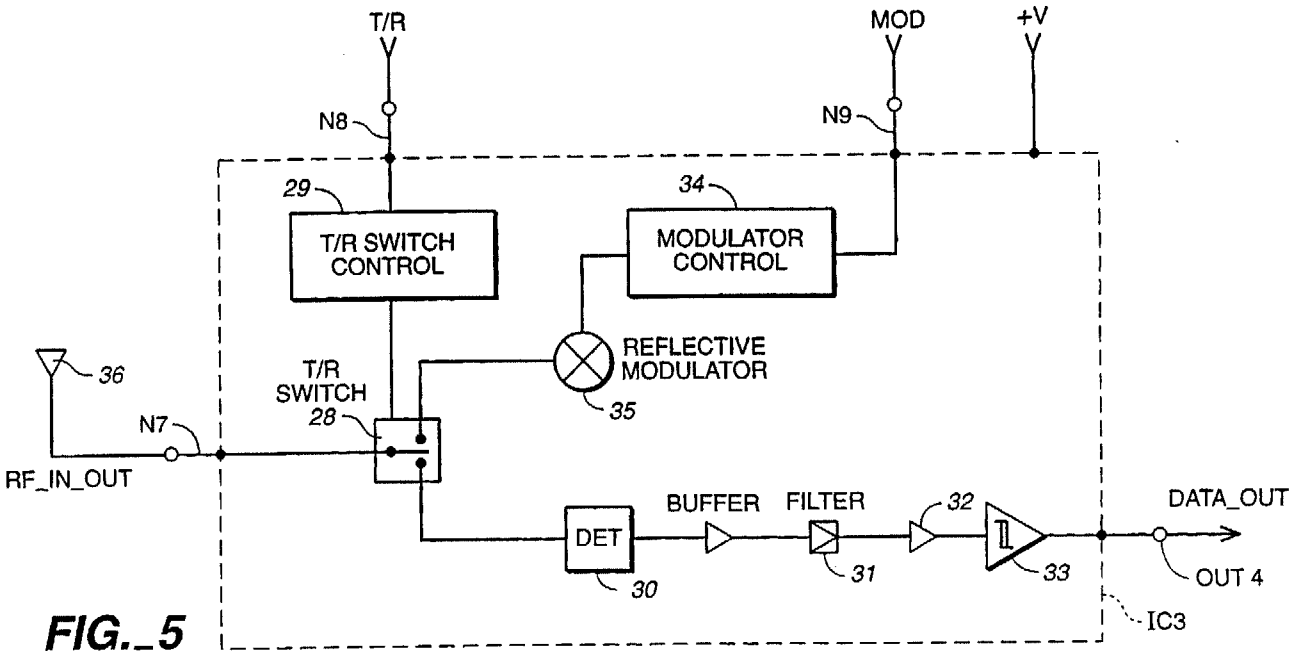

FIG. 5 illustrates one embodiment of a block diagram of an integrated circuit chip IC3 used to implement a transceiver in the personal communication system shown in FIG. 1B. As shown in FIG. 5, the chip design includes a T/R switch 28, T/R switch control unit 29, detector 30, IF filter 31, amplifier 32, detector 33, modulator control 34 and reflective modulator 35.

The elements of IC3 function in the following manner. In the first mode (receive mode for the transceiver) an external antenna 36 coupled to input/output node N7 receives modulated uplink signal 11A from the transmitter. In response to control provided by T/R switch control unit 29, T/R switch 28 directs the uplink signal to detector/demodulator 30. T/R switch control unit 29 is controlled by an external control signal T/R which is coupled to IC3 on node N8. The T/R control originates from an external control source (not shown). The detector, demodulates the RF signal received from the transmitter and puts out an IF signal representing the information signal received on antenna 36. The information signal is then processed by the IF filter stage 31, the amplifier stage 32, and the detector stage 33 in the same manner as described above for corresponding elements in IC2. Detector stage 33 recovers a digital signal representing the IF information signal which is then coupled to output node OUT4. Output node OUT4 is coupled to an external digital signal processor (not shown) which functions to interpret the digital signals and respond in some manner. The manner in which the external digital system interprets and uses these digital signals is dependent on the information encoded within them. For instance in the case in which the system is used as a hearing aid system, audio signals would then be provided to a user via a speaker. In the case in which the digital signal is a command from the transmitter unit, the external digital signal processor may respond by transmitting a response back to the transmitter or by changing the internal mode of operation of the earpiece.

When the system is in the second mode of operation (transmit mode for the transceiver), the T/R switch control unit 29 controls T/R switch 28 so as to route the unmodulated oscillator signal received from the transmitter on antenna 36 to reflective modulator 35. At the same time, reflective modulator 35 (controlled by modulator control 34 via signal MOD coupled to node N9) either grounds or opens antenna 36 which effectively modulates the unmodulated signal such that a 180° phase change occurs in the received signal depending on whether the antenna is grounded or opened. The modulated signal is then reflected back to the receiver 13. It should be noted that although this is a BPSK type of modulation, the transceiver may be implemented to perform other types of modulation such as amplitude modulation. The MOD control signal is a digital signal representing the information signal to be transmitted to the receiver. In one embodiment, the MOD control signal is provided from an external digital signal processor (not shown). The MOD control signal may be digital samples of an audio signal received by the earpiece microphone or may represent a control signal from the transceiver to be transmitted to receiver 13. Transceiver chip, IC3, also includes a power port Vt. It should be noted that since the transceiver chip is to be located in a device to be placed on or within the ear of the user it is optionally designed to require a minimal number of external devices. However, it should also be well understood that some conventional external components are necessary.

The transceiver chip IC3 is designed to switch between a transmit state to a receive state and back with such rapidity that the system provides clear communication to the user and so that the system appears to provide full-duplex communication to the user of the communication system shown in FIG. 1B. In one embodiment, the elements of IC3 are designed so that the transceiver 10 switches between states in a time interval in the range of 5.0–10.0 micro seconds. An example as to how to design the elements of IC3 so as to ensure this minimum time interval is to disconnect external capacitors during certain times of operation and/or to change bias currents at certain key times during the operation of the system.

Another design consideration relates to the power consumption of IC3 as related to supply voltage and current usage. The power consumption of IC3 is significantly reduced since it does not need to provide RF power to send signals to the receiver but instead reflects the RF power provided from the transmitter to perform signal transmission. Hence, the elements of IC3 all of which operate at frequencies well below that of the RF carrier signal require little power. In one embodiment, power supply and current usage are in the range of 3.0 volts@100–150 micro Amps. Minimizing power consumption in this manner maximizes battery life to the user. Moreover, minimizing power consumption also allows for a reduction in battery size thereby facilitating the miniaturization of the earpiece to a size compatible with placing it within the ear of the system user.

Finally, in the embodiment shown in FIG. 5, IC3 is designed such that all elements are active and ready to receive a transmission at any time. In other words, IC3 is not designed to include a sleep mode. Hence, in this type of system the user always wants to be ready to receive any expected or unexpected ambient sounds. In an embodiment not shown in FIG. 5, the transceiver chip may include a sleep mode. In this type of system, the transceiver may be awakened at predetermined times when transmissions are expected or the transceiver may be sent a wake-up command from the transmitter/receiver.

It should be understood that elements within IC1, IC2, and IC3 include communication elements such as an oscillator circuit, a phase lock loop circuit, a modulator circuit, and a power amplifier circuit which are well known communication circuits and may be implemented in a variety of manners. In addition, IC1, IC2, and IC3 include IF signal processing elements such as filters, amplifiers, and comparators which also may be implemented in a variety of manners. However, in accordance with circuit design concept of the chip set, these circuits are designed as a set to meet the above described design criteria so as to optimize the power, size, and cost aspects of the personal communication system shown in FIG. 1B.

The preceding describes an integrated circuit design for a full two-way wide-band audio communication system using reflective technology. In this description, numerous specific details are set forth, such as specific voltages and frequencies in order to provide a thorough understanding of the present invention. It should be apparent, however, to one skilled in the art that these specific details need not be employed to practice the present invention. In other instances, well-known signal processing structures and steps have not been described in detail in order to avoid unnecessarily obscuring the present invention.

Moreover, although the elements of the present invention have been described in conjunction with certain embodiments, it is appreciated that the invention can be implemented in a variety of other ways. Consequently, it is to be understood that the particular embodiments shown and described by way of illustration are in no way intended to be considered limiting. Reference to the details of these embodiments is not intended to limit the scope of the claims which themselves recite only those features regarded as essential to the invention.

What is claimed is:

1. An integrated circuit chip set for a personal two-way wireless communication system including a transmitter, a receiver, and a transceiver, said communication system having a first non-reflective mode of operation wherein said transmitter transmits a modulated uplink signal representing a first set of digitized signals to said transceiver and having a second reflective mode of operation wherein said transceiver transmits a modulated downlink signal representing a second set of digitized signals to said receiver, said chip set comprising:

at least two integrated circuit chips including:

a transmitter integrated circuit portion for transmitting said modulated uplink signal to said transceiver during said first mode and for transmitting an unmodulated signal to said transceiver during said second mode;

a receiver integrated circuit portion having a receiver non-receive state and a receiver receive state in which said receiver is receiving said modulated downlink signal from said transceiver, wherein said receiver circuit portion switches from said non-receive state to said receive state in a first minimum time interval;

a transceiver integrated circuit portion for, in a transceiver receive state, receiving said uplink signal from said transmitter and in a transceiver transmit state for receiving and simultaneously modulating said unmodulated signal so as to generate and transmit said modulated downlink signal to said receiver, wherein said transceiver circuit portion switches from said transceiver transmit state to said transceiver receive state in a second minimum time interval and switches from said transceiver receive state to said transceiver transmit state in a third minimum time interval;

wherein said first, second, and third minimum time intervals have a duration such that said system operates essentially as a full duplex system as perceived by a system user.

2. The chip set as described in claim 1 wherein one of said first set of digital signals and said second set of digital signals are audio digital signals and the other of said first set of digital signals and said second set of digital signals are digital data signals.

3. The chip set as described in claim 1 wherein said first set of digital signals and said second set of digital signals are audio digital signals.

4. The chip set as described in claim 1 wherein said first, second, and third time intervals are in the range of 5 to 10 micro seconds.

5. The chip set as described in claim 1 wherein said chip set is operated at a power such that said system transmissions are within close range of said system user.

6. The chip set as described in claim 5 wherein said transmissions are performed less than 50 feet.

7. The chip set as described in claim 5 wherein said transmissions are performed between 1 to 5 feet.

8. The chip set as described in claim 1 wherein said transceiver circuit portion has a corresponding power supply in the range of 3.0 volts with a typical current usage in the range of 100 mA to 150 mA.

9. The chip set as described in claim 1 wherein said transmitter and receiver integrated circuit portions have a high power dissipation mode and a low power dissipation mode wherein portions of each of said transmitter and receiver circuit portions are essentially disabled or partially shut-down when in said low power dissipation mode.

10. The chip set as described in claim 9 wherein said transceiver integrated circuit portion is in a ready state at all times.

11. The chip set as described in claim 9 wherein said transceiver integrated circuit portion has a high power dissipation mode and a low power dissipation mode wherein portions of said transceiver integrated circuit portion are disabled or partially shut-down when said transceiver integrated circuit portion is in said low power dissipation mode.

12. The chip set as described in claim 1 wherein said transmitter circuit portion includes an amplifier stage and wherein in said first mode said amplifier state has a first gain having an associated magnitude and amplifies said modulated uplink signal and in said second mode said amplifier stage has a second gain having an associated magnitude and amplifies said unmodulated signal wherein said second gain magnitude is greater than said first gain magnitude.

13. The chip set as described in claim 1 wherein said transmitter circuit portion and said receiver circuit portion are integrated onto a single one of said at least two chips.

14. The chip set as described in claim 1 wherein said transmitter circuit portion and said receiver circuit portion are integrated onto separate ones of said at least two chips.

15. The chip set as described in claim 1 wherein said transmitter circuit portion is divided onto more than one chip of said at least two chips.

* * * * *

UNITED STATES PATENT AND TRADEMARK OFFICE

CERTIFICATE OF CORRECTION

PATENT NO. : 5,751,820
DATED : May 12, 1998
INVENTOR(S) : Taenzer

It is certified that error appears in the above-identified patent and that said Letters Patent is hereby corrected as shown below:

The title page should be deleted to appear as per attached title page.

Please delete drawing sheets 1-5 and substitute drawing sheets 1-5 as per attached.

Signed and Sealed this

Sixteenth Day of March, 1999

*Attest:*

Q. TODD DICKINSON

*Attesting Officer*

*Acting Commissioner of Patents and Trademarks*

US005751820A

United States Patent [19]

Taenzer

[11] Patent Number: 5,751,820

[45] Date of Patent: May 12, 1998

[54] INTEGRATED CIRCUIT DESIGN FOR A PERSONAL USE WIRELESS COMMUNICATION SYSTEM UTILIZING REFLECTION

[75] Inventor: Jon C. Taenzer, Los Altos, Calif.

[73] Assignee: ReSound Corporation, Redwood City, Calif.

[21] Appl. No.: 832,573

[22] Filed: Apr. 2, 1997

[51] Int. Cl.[6] ..... H04R 25/00

[52] U.S. Cl. ..... 381/68; 455/66; 455/100

[58] Field of Search ..... 381/68, 68.2, 68.4, 381/23.1, 68.6, 68.7; 455/66, 100, 575, 90

[56] References Cited

U.S. PATENT DOCUMENTS

| | | | |
|---|---|---|---|
| 4,334,315 | 6/1982 | Ono et al. | 455/100 |
| 5,479,522 | 12/1995 | Lindemann et al. | 381/68 |
| 5,621,913 | 4/1997 | Tuttle et al. | 455/66 |

*Primary Examiner*—Huyen Le

*Attorney, Agent, or Firm*—Burns, Doane, Swecker & Mathis, LLP

[57] ABSTRACT

An integrated circuit chip set design for a wireless hearing aid communication system including a battery operated transceiver unit worn in the vicinity of the ear of the user and a compact battery operated transmitter/receiver unit worn by or in close range of the user. The basis of the integrated circuit chip set design is to optimize circuit size, speed, power, and manufacturability for a personal use wireless audio communication system using the reflective transmission technology. Power and speed consideration of the circuits are designed to accommodate wireless audio RF reflective transmissions for a close range to the user. The transceiver and the receiver of the system are designed to switch between certain transmission states in order to facilitate rapid switching between a first mode in which the transmitter is transmitting to the receiver and a second mode in which the transceiver is transmitting to the receiver. The circuits are also integrated using a GaAs process and are operated in the multi-GHz range so that the circuits dissipate relatively low power.

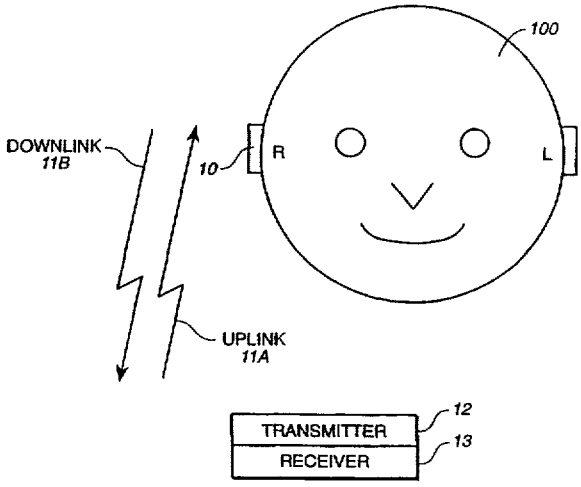

15 Claims, 5 Drawing Sheets